US007191498B2

(12) United States Patent
Fischer

(10) Patent No.: US 7,191,498 B2
(45) Date of Patent: Mar. 20, 2007

(54) CREMATION URN

(76) Inventor: Michael Fischer, 9705 27th Ave. North, Plymouth, MN (US) 55441

( * ) Notice: Subject to any disclaimer, the term of this patent is extended or adjusted under 35 U.S.C. 154(b) by 57 days.

(21) Appl. No.: 10/662,076

(22) Filed: Sep. 12, 2003

(65) Prior Publication Data

US 2005/0055812 A1 Mar. 17, 2005

(51) Int. Cl.
*A61G 17/00* (2006.01)

(52) U.S. Cl. ..... 27/1

(58) Field of Classification Search ..... 27/1; D99/5, 19; 40/124.5; 52/103, 104
See application file for complete search history.

(56) References Cited

U.S. PATENT DOCUMENTS

| | | | | |
|---|---|---|---|---|
| 3,990,198 | A | | 11/1976 | Ortutay |
| D258,125 | S | * | 2/1981 | Bailey ..... D11/157 |
| D304,641 | S | * | 11/1989 | Bourassa ..... D99/5 |
| 5,172,457 | A | * | 12/1992 | Allen et al. ..... 27/1 |
| D334,642 | S | * | 4/1993 | Allen ..... D99/5 |
| 5,230,127 | A | | 7/1993 | Zukowski et al. |
| 5,239,733 | A | | 8/1993 | Vail, III et al. |
| D341,467 | S | * | 11/1993 | Allen ..... D99/5 |
| 5,379,499 | A | | 1/1995 | Jackson |
| 5,477,594 | A | | 12/1995 | LePage |
| 5,625,933 | A | | 5/1997 | Neuberger et al. |
| 5,647,108 | A | | 7/1997 | Crook |
| 5,709,441 | A | * | 1/1998 | Bartling et al. ..... 312/107 |
| 5,732,452 | A | | 3/1998 | Riedel, II |
| D398,733 | S | | 9/1998 | Diviak, Sr. |
| D401,732 | S | | 11/1998 | Parker |
| 5,875,528 | A | | 3/1999 | Parker |
| 5,881,505 | A | | 3/1999 | Larkin, III et al. |
| 5,903,961 | A | | 5/1999 | Parker et al. |
| D415,329 | S | | 10/1999 | Parker |
| 6,006,458 | A | | 12/1999 | Weiss |
| 6,044,532 | A | | 4/2000 | Bowling et al. |
| 6,076,292 | A | | 6/2000 | Kawa |
| 6,112,382 | A | | 9/2000 | Parker et al. |
| D437,098 | S | | 1/2001 | Rivera et al. |
| 6,175,995 | B1 | | 1/2001 | Parker et al. |
| D437,250 | S | | 2/2001 | Hull et al. |
| D437,670 | S | | 2/2001 | Rivera et al. |
| D438,361 | S | | 2/2001 | Robinson |
| D438,362 | S | | 2/2001 | Robinson |
| 6,189,188 | B1 | | 2/2001 | O'Hare |
| D443,400 | S | | 6/2001 | Robinson |

(Continued)

OTHER PUBLICATIONS

Patently Coincidental, *Funeral Monitor*, Feb. 17, 2003 pp. 5-6.

(Continued)

*Primary Examiner*—William L. Miller
(74) *Attorney, Agent, or Firm*—Crompton, Seager & Tufte LLC

(57) ABSTRACT

Cremation urns for storing and displaying cremated remains, including methods of forming such devices, are disclosed. A cremation urn in accordance with an embodiment of the present invention may include an urn assembly coupled to an extending below a mineral slab. The urn assembly may include a container body, neck portion, and lid that together can be used to store human or animal cremated remains. A display stand including a number of support legs can be used to support the mineral slab in an upright and angled position, if desired.

33 Claims, 7 Drawing Sheets

U.S. PATENT DOCUMENTS

| | | | | |
|---|---|---|---|---|
| D443,748 | S | 6/2001 | Rivera et al. | |
| D444,288 | S | 6/2001 | Robinson | |
| D445,557 | S | 7/2001 | Chang | |
| 6,279,212 | B1 | 8/2001 | Balch | |
| D449,418 | S | 10/2001 | Robinson | |
| 6,295,705 | B1 | 10/2001 | Gersten | |
| D452,945 | S | 1/2002 | Albuquerque et al. | |
| D456,976 | S | 5/2002 | Rivera et al. | |
| 6,389,664 | B1 | 5/2002 | Wood et al. | |
| 6,463,703 | B1 * | 10/2002 | Mattis | 52/103 |
| 6,493,911 | B1 | 12/2002 | Troin et al. | |
| 6,520,606 | B1 * | 2/2003 | Robinson | 312/111 |
| 6,571,439 | B1 * | 6/2003 | Sens | 27/1 |

OTHER PUBLICATIONS

Harr, A reporter at Large The Burial, *The New Yorker*, Nov. 1, 1999, pp. 70-95.
The journey home starts here . . . advertisement, *The American Cemetery*, Dec. 2000, p. 16.
Double Companion Memorial, http://www.theeverlastingurn.com/products/duble.htmal, Jun. 1, 2002.
Natural Stone Plinth, http://www.theeverlastingurn.com/products/plinth.html, Jun. 1, 2002.
Memorial Monolith, http://www.theeverlastingurn.com/products/monolinth.html, Jun. 1, 2002.
Memorial Marker, http://www.theeverlastingurn.com/products/marker.html, Jun. 1, 2002.
Meierjohn-Wengler, Aurora Preferences Catalog.
Batesville, Options Catalog, 2002.
Matthews International Corporation, Memorial Urn Catalog, 2001.
Outdoor Pet Urn, Granite Garden Stone Urn, http://www.bubbling-well.com/FP-GardenStone.htm, Apr. 10, 2002, 2 pgs.
Moses, T., Cremation Nation, http://www.metroactive.com/papers/sonoma/01.03.02/cremation1-0201.html, Apr. 10, 2002, 13 pages.
Matthews International Corporation, http://www.matthewsbronze.com/BronzeHomepageTemp.html, Apr. 10, 2002.
Matthews International Corporation, http://www.matthewsbronze.com/ProductsLinkTemp.html, Apr. 10, 2002.

* cited by examiner

CREMATION URN

FIELD OF THE INVENTION

The present invention relates generally to the field of funeral products. More specifically, the present invention relates to cremation urns for storing and displaying cremated remains.

BACKGROUND OF THE INVENTION

Cremation is becoming increasingly popular in the funeral industry as an acceptable alternative to more traditional burial methods. As a result, there has been a significant increase in the demand for cremation urns to store and display cremated remains. Such urns are available in a wide variety of designs and styles, including cubes, jars, vases, sculptures, bookends, mausoleums, and garden implements. Although a majority of the urns commercially available are configured for human remains, smaller keepsake versions are also available for storing animal remains.

Cremation urns may be made from a variety of materials such as bronze, wood, cloisonné, turned-stone, plastic and/or glass (ceramic). The particular application of a certain material will often depend on the environment in which the urn is to be displayed. In urns configured for outdoor use, for example, relatively durable materials that are resistant to sun, moisture and other environmental factors are typically preferred over less robust materials. The aesthetics of the cremation urn will also dictate the type of materials used in forming the cremation urn. Factors such as cost and ease of manufacturing, uniformity, weight, size, longevity, and affordability are also important considerations in the selection of materials.

SUMMARY OF THE INVENTION

The present invention relates to cremation urns for storing and displaying cremated remains. A cremation urn in accordance with an exemplary embodiment of the present invention may include an urn assembly, a mineral slab, and a display stand. The urn assembly may include a container body having an internal chamber configured to receive and store cremated remains. A neck portion and lid disposed through an opening in the mineral slab may be employed to provide quick access to the contents of the container body from a position above the upper surface of the mineral slab. An elastomeric sleeve coupled to the lid may be employed to tightly seal the lid to the neck portion.

The mineral slab may include an outer perimeter having a rocky or rough texture or shape that provides a naturalistic appearance to the cremation urn. The mineral slab may be made from a variety of naturally occurring substances that can be machined to impart a desired shape and appearance to the cremation urn. An optional display stand may be used to support the mineral slab in an upright and angled position to improve the viewing angle from above. In certain embodiments, the display stand may include a number of support legs of differing length configured to orient the mineral slab upwardly at a desired angle. The display stand may be formed from a material visually different than the mineral slab to provide an aesthetic contrast or to accentuate the mineral slab, if desired.

DETAILED DESCRIPTION OF THE INVENTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

Figure 1:
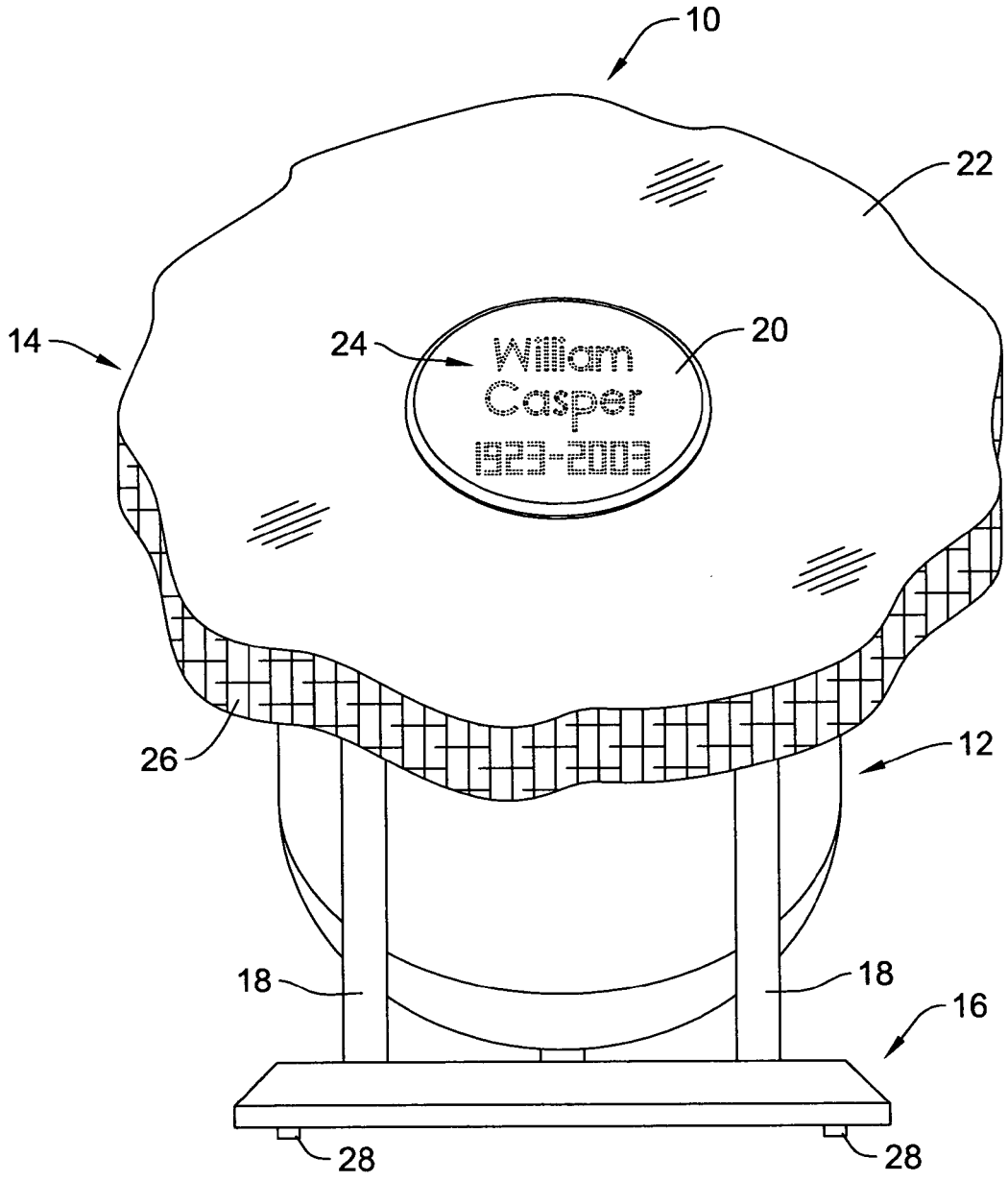
FIG. 1 is a front perspective view illustrating a cremation urn in accordance with an exemplary embodiment of the present invention.
Figure 2:
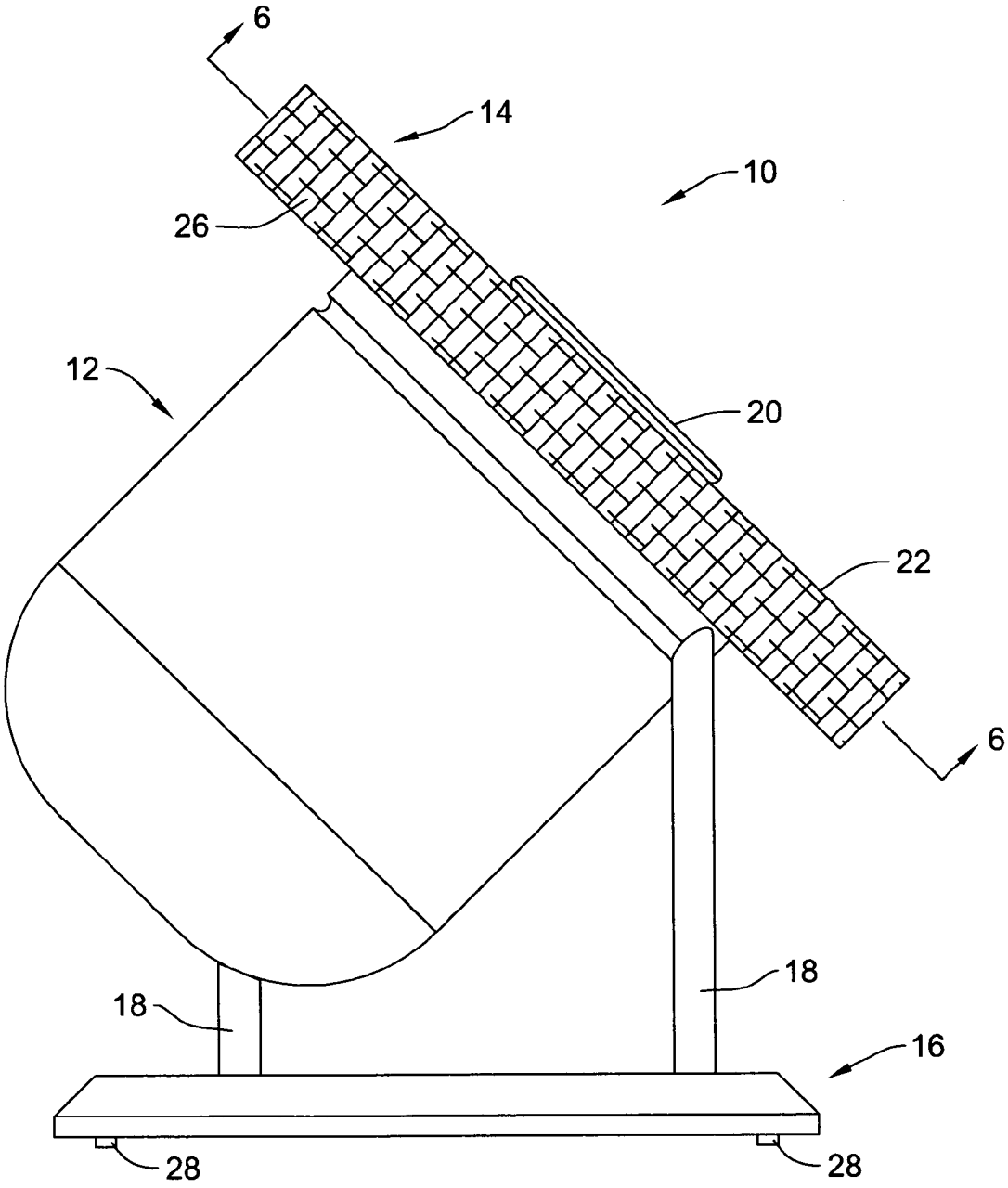
FIG. 2 is a side perspective view of the cremation urn illustrated in FIG. 1.

FIGS. 1 and 2 are, respectively, front and side perspective views illustrating a cremation urn 10 in accordance with an exemplary embodiment of the present invention. Cremation urn 10 includes an urn assembly 12 coupled to and extending below a mineral slab 14 that is used as an aesthetic facade to conceal or obscure the urn assembly 12 when viewed from above. The urn assembly 12 and mineral slab 14 can both be supported in an upright position with the use of an optional display stand 16 having a number of support legs 18 which orient the mineral slab 14 at an angle.

A lid 20 coupled to the mineral slab 14 may be used to gain access to the urn assembly 12 through the mineral slab 14. Lid 20 extends below the upper surface 22 of the mineral slab 14 through a cored opening 56 (see FIG. 6) formed through the mineral slab 14, permitting quick and easy access to the contents of the urn assembly 12 from a position above the upper surface 22 of the mineral slab 14. The lid 20 may be configured to lie flush with the upper surface 22 of the mineral slab 14 to provide a level or flat appearance, if desired As can be further seen in FIG. 1, the lid 20 may include information about the deceased, a personalized message, an insignia, or other desired markings 24. The markings 24 may be formed by any number of suitable marking techniques, including rotary engraving, laser marking, photochemical etching, or the like. In a computerized rotary engraving process, for example, a cutting blade made of a hard material (e.g. tungsten carbide) may be rotatably engaged on selective portions of the lid 20 to form indentations on the lid surface. A contrast media such as black paint may be filled into the formed indentations, and then lacquer coated and/or heat-treated to prevent oxidation or flaking from occurring.

The mineral slab 14 may be formed from a variety of naturally occurring substances that can be machined to impart a desired shape and appearance. Examples of natural mineral slabs suitable for use include, but are not limited to, Brazilian Agate, Blue Sodalite, Aventurine (i.e. green quartz), Rose Quartz, Rock Crystal, Zebra Jasper, Orange Calcite, Petrified Wood, Lepidolite, Tigereye, Black Agate, or the like. Artificial materials that simulate the texture and appearance of natural mineral slabs may also be employed, if desired.

The outer perimeter 26 of the mineral slab 14 may have a rocky or rough texture and shape that provides a naturalistic appearance to the cremation urn 10. In addition, the upper surface 22 of the mineral slab 14 may also be buffed or polished to provide a mirrored finish, if desired. The dimensions of the mineral slab 14 may be varied to alter the appearance of the cremation urn 12, and to permit the urn 10 to fit in standard urn vaults or regular-sized columbarium niches. In the exemplary embodiment illustrated in FIGS. 1–2, the mineral slab 14 has a generally circular shape with an outer diameter in the range of about 3–12 inches, and a thickness of about 0.5 to 2 inches. Other shapes and sizes can be implemented, however, as desired.

Figure 3:
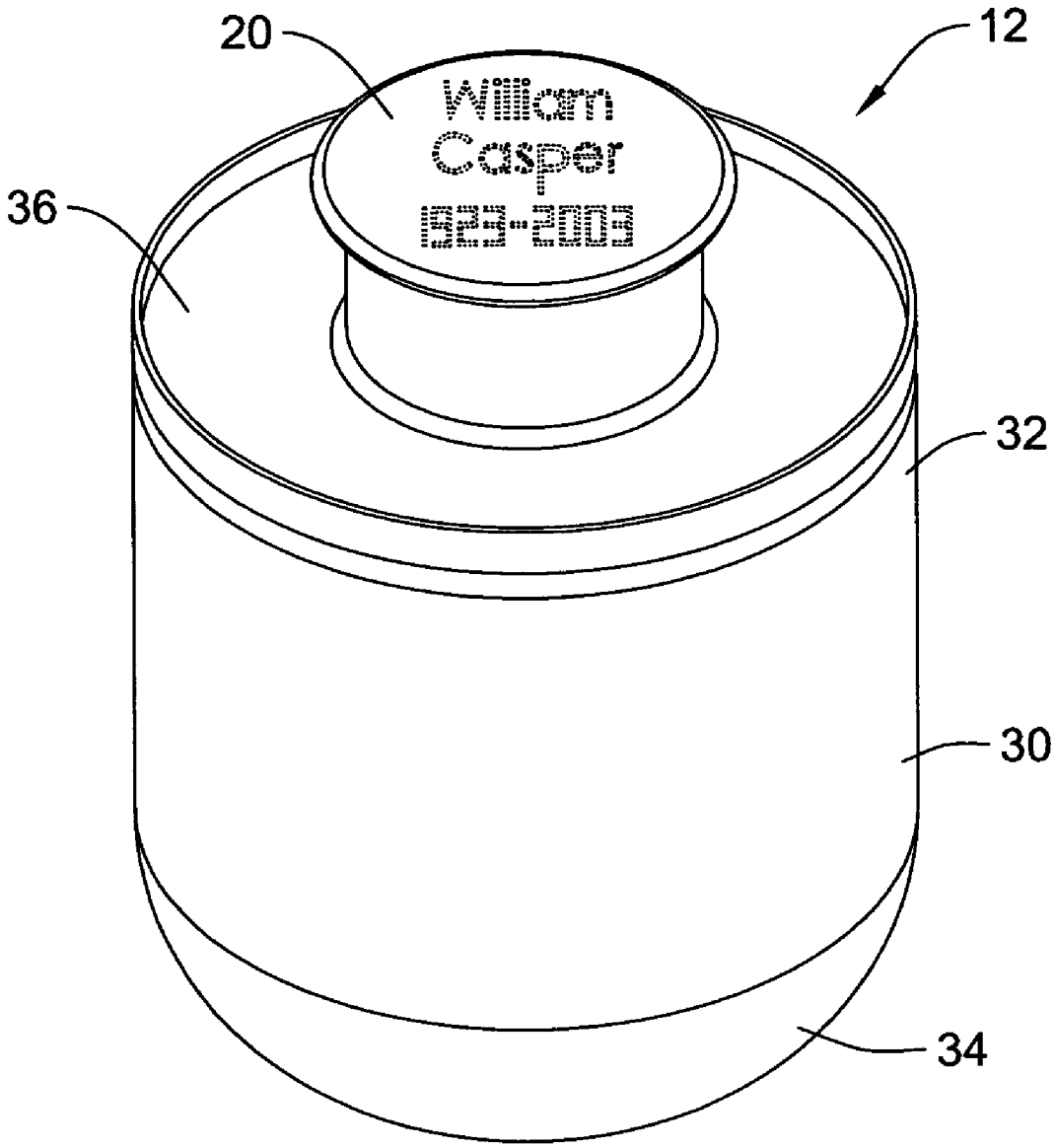
FIG. 3 is a front perspective view of the urn assembly of FIG. 1.

FIG. 3 is a perspective view illustrating the urn assembly 12 of FIGS. 1–2. As shown in FIG. 3, urn assembly 12 may include a generally cylindrical-shaped container body 30 having an upper portion 32, a lower portion 34, and a neck portion 36. The container body 30, neck portion 36 and lid 20 may each be formed of a metal or metal alloy such as bronze, copper, or stainless steel. Alternatively, a suitably strong polymeric material such as polyvinylchloride (PVC), nylon or ABS may be used to form the container body 30, neck portion 36 and lid 20 components. Fabrication of the various components can be accomplished by metal spinning, casting, braising, molding, or other suitable process.

Figure 4:
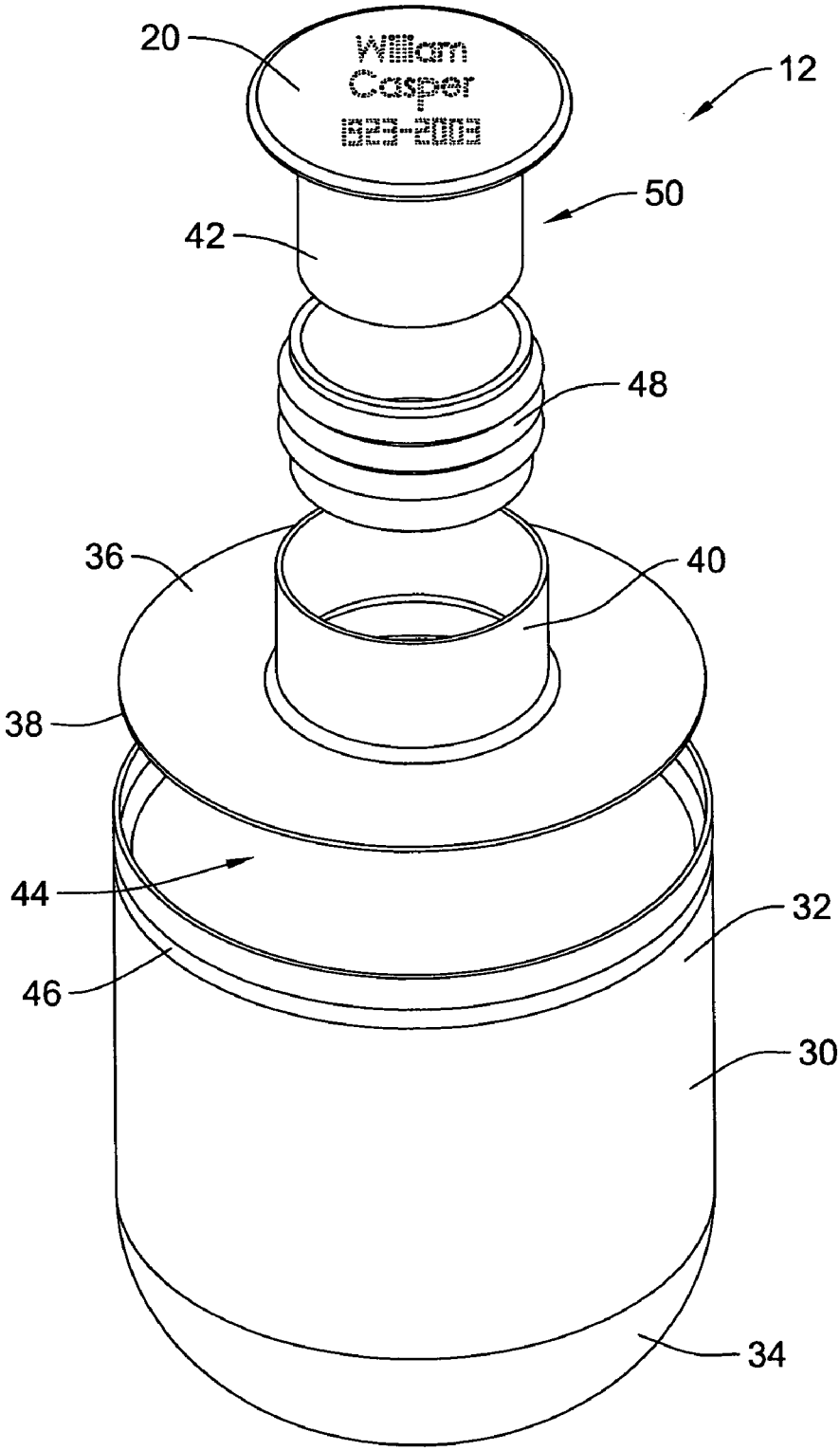
FIG. 4 is an assembly view of the various components of the urn assembly illustrated in FIG. 3.

As shown in the assembly view of FIG. 4, the neck portion 36 may include a flanged section 38 configured to fit on the upper portion 32 of the container body 30, and a tubular shaft section 40 configured to receive a tubular shaft section 42 of the lid 20. The flanged section 38 of neck portion 36 may be suitably dimensioned to fit within the interior of the container body 30, forming an internal chamber 44 configured to receive and store cremated remains therein. A crimp 46 or other fastening means may be used to tightly secure the flanged section 38 to the upper portion 32 of the container body 30.

Figure 5:
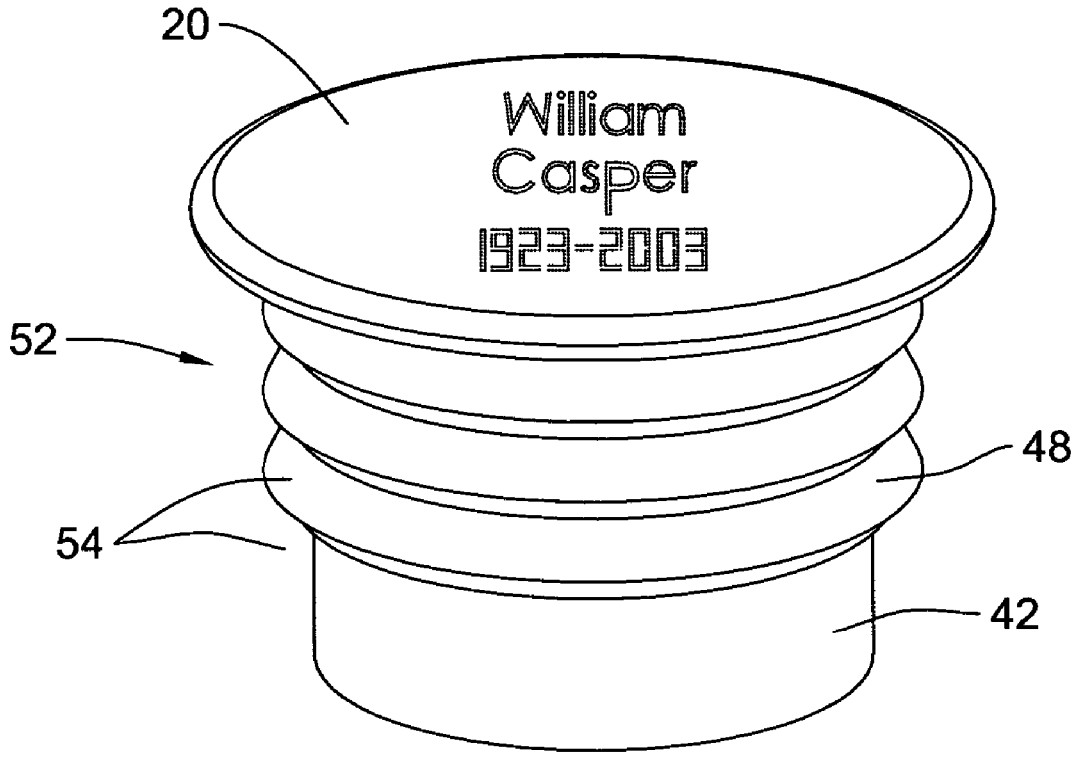
FIG. 5 is a perspective view showing the elastomeric member coupled to the lid.

An elastomeric sleeve 48 configured to tightly fit about the outer periphery 50 of the tubular shaft section 42 may be used to releasably secure the lid 20 to the neck portion 36. The elastomeric sleeve 48 may be formed from a rubber material that can be used to hermetically seal the urn assembly 12. Examples of suitable rubber materials include neoprene, styrene-butadiene rubber (SBR), nitrile, nitrile PVC, hydrogenated nitrile (HNBR), polyisoprene, butyl, VITON, silicone, flurosilicon, urethane, or the like. As shown in FIG. 5, the outer periphery 52 of the elastomeric sleeve 48 may include a number of circumferentially disposed gripping fins 54 that tightly grip and seal within the interior of the tubular shaft section 40. In use, the elastomeric sleeve 48 forms a tension fit with the tubular shaft section 40 that can be overcome by pulling the lid 20 away or apart from the neck portion 36.

Although the use of an elastomeric sleeve 48 is specifically illustrated in FIGS. 4–5, it should be understood that the lid 20 may be secured to the neck 40 using any number of suitable attachment means. In certain embodiments, for example, a threaded locking mechanism, setscrew, key, bayonet fitting, adhesive or other fastening device and/or material may be utilized to secure the lid 20 to the neck 40.

The container body 30 can be formed into a variety of shapes to suit customer preferences or other design considerations. In the exemplary embodiment depicted in FIG. 3, the container body 30 has a substantially cylindrical shape with a rounded lower portion 34. Other container shapes such as conical, rectangular, pyramid, etc. may also be employed, as desired. In certain embodiments, the ratio of the outer dimension to the length may be increased slightly to provide a container body 30 with a shorter overall length without materially affecting the storage space of the urn. The dimensions of the container body 30 may be selected to correspond to the outer perimeter 26 of the mineral slab 14 such that, when viewed from above, the container body 30 is substantially concealed or obscured from view.

The container body 30 may be dimensioned to accommodate either human or animal cremation remains. In certain embodiments, for example, the container body 30 can be sized to hold approximately 200 cubic inches of cremated remains, which corresponds to a containment space large enough to hold the cremated remains of approximately 99% of the human population. The container body 30 may also be available in smaller keepsake sizes, which can be used to hold animal cremation remains or a portion of human cremated remains.

Figure 6:
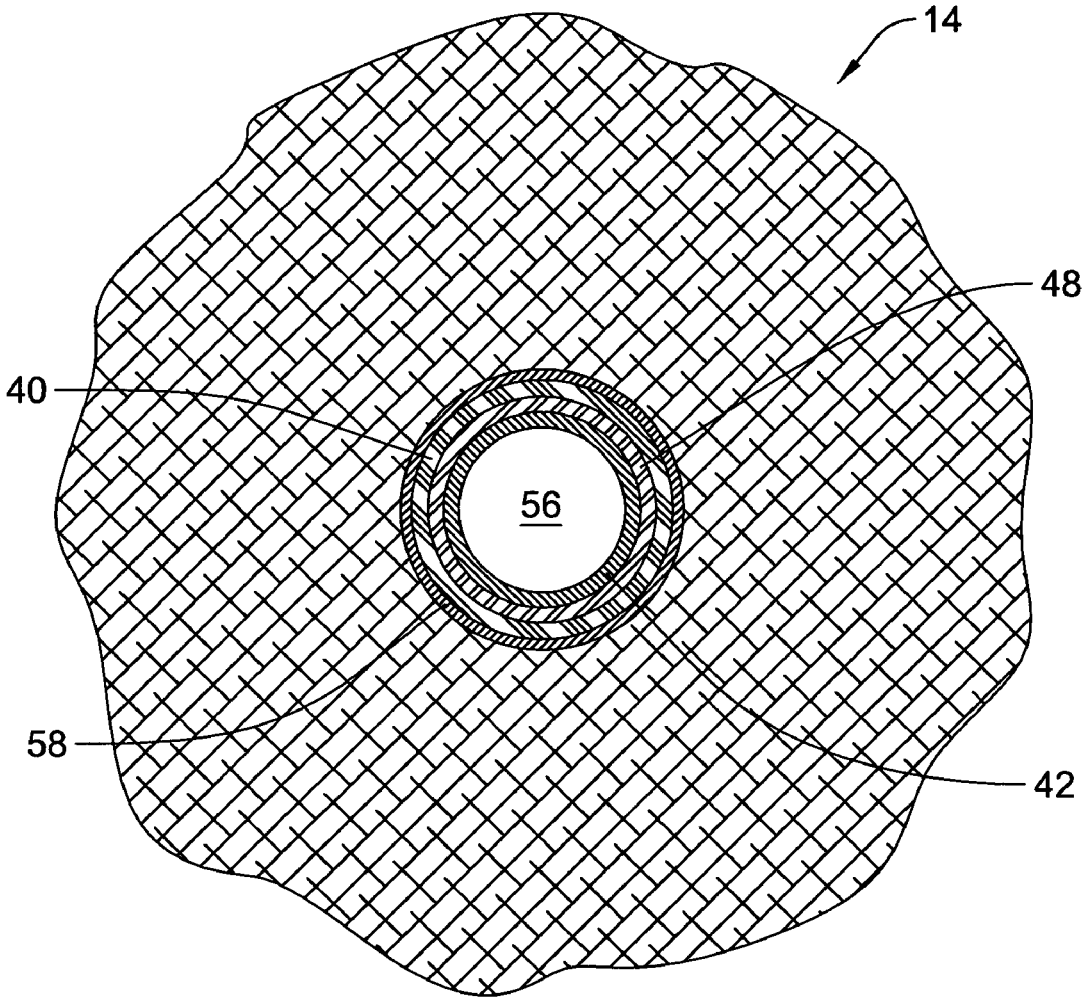
FIG. 6 is a cross-sectional view along line 6—6 of FIG. 2, showing the connection of the urn assembly to the mineral slab.

FIG. 6 is a cross-sectional view along line 6—6 of FIG. 2, showing the connection of the urn assembly 12 to the mineral slab 14. An opening 56 formed through the mineral slab 14 may be configured to receive the tubular shaft section 40 of neck portion 36, the tubular shaft section 42 of lid 20, and the elastomeric sleeve 48. As can be seen in FIG. 6, the tubular shaft section 42 of the lid 20 may be configured to fit hand-in-glove into the tubular shaft section 40 of neck portion 36. In an alternative embodiment (not depicted), the arrangement of the lid 20 and neck portion 36 may be reversed such that the tubular shaft section 40 of neck portion 36 fits hand-in-glove into the tubular shaft section 42 of lid 20. The core opening 56 may be formed at or near the center of the mineral slab, as shown in FIG. 6, or can be offset a distance if desired.

The opening 56 may be formed by core drilling or other suitable process. In a core drilling process, for example, a high-pressure spray nozzle or diamond-tipped drilling rig may be used to form a substantially circular hole in the mineral slab 14. Because mineral slab is specifically employed, tighter tolerances and greater consistency may be achieved over other materials used in the art such as granite or marble. Once the opening 56 has been formed, a bonding layer 58 may be used to attach the tubular shaft section 40 of neck portion 36 to the mineral slab 14. The bonding layer 58 may include an epoxy or other suitable adhesive that, when cured, secures the tubular shaft section 40 of neck portion 36 to the mineral slab 14.

Figure 7:
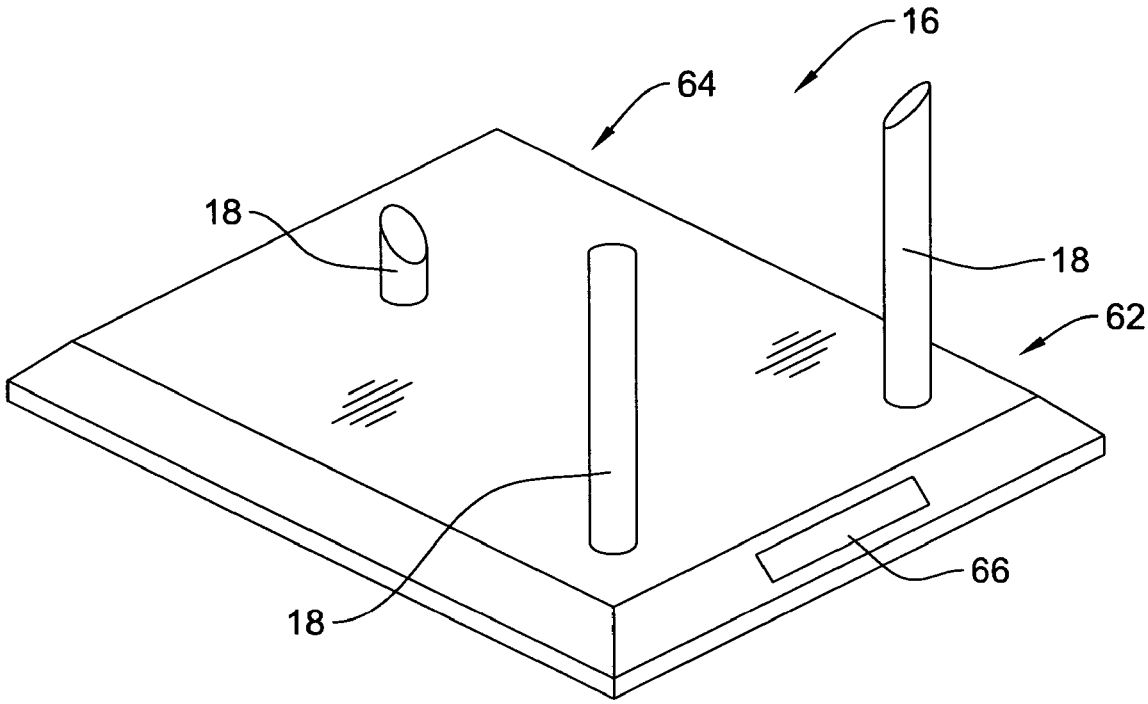
FIG. 7 is a front-left perspective view of the display stand illustrated in FIGS. 1–2.

FIG. 7 is a front-left perspective view of the display stand 16 illustrated in FIGS. 1–2. As shown in FIG. 7, the display stand 16 may include a number of support legs 18 configured to support the container body 30 in an upright and angled position. The display stand 16 may have a rectangular shape of sufficient size to firmly support the urn assembly 12 and mineral slab 14. A number of non-skid support feet 28 (see FIGS. 1–2) disposed on the bottom of the display stand 16 may be employed to prevent movement on a supporting surface such as a mantel or bookshelf.

The support legs 18 located at the front portion 62 of the display stand 16 may be made larger than the support legs 18 located at the rear portion 64 of the display stand 16 to orient the mineral slab 14 at an angle for improved viewability. The support legs 18 may be configured to orient the mineral slab 14 at any viewing angle ranging from 0° (i.e. a fully horizontal position) to an angle of 90° (i.e. a fully vertical position). In use, the support legs 18 stabilize the urn assembly 12 and mineral slab 14, and provide a floating appearance when viewed from above.

The display stand 16 may be constructed from materials different from the mineral slab 14 to enhance the aesthetics of the cremation urn 10. In certain embodiments, for example, the display stand 16 may be constructed from hardwoods such as oak, walnut, cedar, or cherry, and may include a protective coating of urethane or other suitable sealant. In other embodiments, the display stand 16 may be constructed from polymeric materials such as a clear acrylic or polyethylene to accentuate the mineral slab 14. If desired, a small placard 66 may be placed on the display stand 16 describing the history and origin of the materials used in the construction of the mineral slab 14 and/or display stand 16.

The cremation urn can be configured for use in both indoor and outdoor applications, as desired. In certain outdoor applications, for example, the display stand 16 can be removed to permit the cremation urn 10 to be buried flush with the ground. Since the urn assembly 12 is accessible from a position above the mineral slab 14, the contents of the cremation urn 10 can be easily accessed without first removing the urn 10 from the ground.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes may be made in details, particularly in matters of shape, size and arrangement of parts without exceeding the scope of the invention.

What is claimed is:

1. A cremation urn, comprising:

a mineral slab having an upper surface, a bottom surface, and an opening therethrough;

a container body extending below the bottom surface of said mineral slab, the container body including an internal chamber configured to receive cremation remains therein;

a neck portion including a flanged section coupled to the container body, and a tubular shaft section configured to fit within the opening of the mineral slab; and a lid removably coupled to the tubular section of the neck portion.

2. The cremation urn of claim 1, wherein the lid is configured to hermetically seal the internal chamber of the container body.

3. The cremation urn of claim 1, wherein the lid includes an upper surface having one or more markings formed therein.

4. The cremation urn of claim 1, wherein the lid includes a shaft section configured to fit within the shaft section of said neck portion.

5. The cremation urn of claim 1, further comprising an elastomeric sleeve.

6. The cremation urn of claim 5, wherein the elastomeric sleeve includes a plurality of gripping fins.

7. The cremation urn of claim 1, further comprising a display stand for supporting the mineral slab in an upright and angled position.

8. The cremation urn of claim 7, wherein the display stand includes a plurality of support legs.

9. The cremation urn of claim 7, wherein the display stand is formed of wood.

10. The cremation urn of claim 7, wherein the display stand is formed of a polymer.

11. The cremation urn of claim 1, wherein the container body, neck portion and lid are each formed of a metal.

12. The cremation urn of claim 1, wherein the mineral slab is selected from the group of materials consisting of Brazilian Agate, Blue Sodalite, Aventurine, Rose Quartz, Rock Crystal, Zebra Jasper, Orange Calcite, Petrified Wood, Lepidolite, Tigereye, and Black Agate.

13. A cremation urn, comprising:

a mineral slab having an upper surface, a bottom surface, and an opening therethrough;

a container body extending below the bottom surface of the mineral slab, the container body including an internal chamber configured to receive cremation remains therein;

a neck portion including a flanged section coupled to the container body, and a tubular shaft section configured to fit within the opening of the mineral slab; and a lid removably coupled to the tubular section of the neck portion, the lid including an elastomeric sleeve configured to fit within the shaft section of said neck portion.

14. The cremation urn of claim 13, wherein the lid is configured to hermetically seal the internal chamber of the container body.

15. The cremation urn of claim 13, wherein the lid includes an upper surface having one or more markings formed therein.

16. The cremation urn of claim 13, wherein the lid includes a shaft section configured to fit within the shaft section of said neck portion.

17. The cremation urn of claim 13, wherein the elastomeric sleeve includes a plurality of gripping fins.

18. The cremation urn of claim 13, further comprising a display stand for supporting the mineral slab in an upright and angled position.

19. The cremation urn of claim 18, wherein the display stand includes a plurality of support legs.

20. The cremation urn of claim 18, wherein the display stand is formed of wood.

21. The cremation urn of claim 13, wherein the display stand is formed of a polymer.

22. The cremation urn of claim 13, wherein the container body, neck portion and lid are each formed of a metal.

23. The cremation urn of claim 13, wherein the mineral slab is selected from the group of materials consisting of Brazilian Agate, Blue Sodalite, Aventurine (i.e. green quartz), Rose Quartz, Rock Crystal, Zebra Jasper, Orange Calcite, Petrified Wood, Lepidolite, Tigereye, and Black Agate.

24. A cremation urn, comprising:

a mineral slab having an upper surface, a bottom surface, and an opening therethrough;

a container body extending below the bottom surface of the mineral slab, the container body including an internal chamber configured to receive cremation remains therein;

a neck portion including a flanged section coupled to the container body, and a shaft section configured to fit within the opening of the mineral slab;

a lid removably coupled to the shaft section of said neck portion; and a display stand for supporting the mineral slab in an upright and angled position.

25. A system for displaying a cremation urn, comprising:

a mineral slab having an upper surface and a bottom surface;

a cremation urn assembly secured to and extending at least in part below the bottom surface of the mineral slab, the cremation urn assembly comprising a container body having a top surface contiguous with the bottom surface of the mineral slab, a neck portion, and a lid coupled to the container body; and a display stand configured to support the urn assembly and mineral slab in an upright and angled position.

26. A cremation urn, comprising:

a mineral slab having an upper surface, a bottom surface, and an outer perimeter;

a rectangular container body having a top surface contiguous with the bottom surface of the mineral slab and extending at least in part below the bottom surface of the mineral slab, the container body including an internal chamber configured to receive cremated remains therein;

a lid coupled to the container body; and a display stand for supporting the container body and mineral slab;

wherein the mineral slab is oriented in an upright and angled position.

27. The cremation urn of claim 26, wherein the mineral slab has a textured outer perimeter.

28. The cremation urn of claim 26, wherein the container body is formed from a metal.

29. The cremation urn of claim 26, wherein the display stand includes a plurality of support legs.

30. The cremation urn of claim 26, wherein the display stand is a rectangular display stand.

31. The cremation urn of claim 26, wherein said upright and angled position is between a fully horizontal position and a fully vertical position.

32. A cremation urn, comprising:

a mineral slab having an upper surface and a bottom surface;

a container body having a top surface contiguous with the bottom surface of the mineral slab and extending at least in part below the bottom surface of the mineral slab, the container body including an internal chamber configured to receive cremated remains therein;

a lid coupled to the container body; and a display stand for supporting the container body and mineral slab;

wherein the mineral slab is oriented in a fully horizontal position.

33. A cremation urn, comprising:

a mineral slab having an upper surface, a bottom surface, and an outer perimeter;

a container body having a top surface contiguous with the bottom surface of the mineral slab and extending at least in part below the bottom surface of the mineral slab, the container body including an internal chamber configured to receive cremated remains therein;

a lid coupled to the container body; and a display stand for supporting the container body and mineral slab;

wherein the mineral slab is oriented in a hilly vertical position.

* * * * *